US008978286B2

(12) United States Patent
Schafer

(10) Patent No.: US 8,978,286 B2
(45) Date of Patent: Mar. 17, 2015

(54) FIREARM CHOKE TUBE

(71) Applicant: Browning, Morgan, UT (US)

(72) Inventor: Nicholas P. Schafer, Ogden, UT (US)

(73) Assignee: Browning, Morgan, UT (US)

( * ) Notice: Subject to any disclaimer, the term of this patent is extended or adjusted under 35 U.S.C. 154(b) by 163 days.

(21) Appl. No.: 13/645,242

(22) Filed: Oct. 4, 2012

(65) Prior Publication Data

US 2014/0096426 A1 Apr. 10, 2014

(51) Int. Cl.
*F41A 21/00* (2006.01)
*F41A 21/40* (2006.01)

(52) U.S. Cl.
CPC ..... *F41A 21/40* (2013.01)
USPC ..... 42/79

(58) Field of Classification Search
CPC ..... F41A 21/40; F41A 21/42; F41A 21/36; F41A 21/16; F41A 21/30; F41A 21/18; F41A 21/28; F41A 21/34
USPC ..... 42/79
See application file for complete search history.

(56) References Cited

U.S. PATENT DOCUMENTS

| | | | | | |
|---|---|---|---|---|---|
| 1,455,661 | A | * | 5/1923 | Rhinehart | 42/79 |
| 1,508,605 | A | * | 9/1924 | Legett et al. | 42/79 |
| 1,679,048 | A | * | 7/1928 | Wright | 42/79 |
| 1,773,260 | A | * | 8/1930 | Cutts | 42/79 |
| 1,892,522 | A | * | 12/1932 | White | 42/79 |
| 2,092,649 | A | * | 9/1937 | Jung | 42/79 |
| RE20,958 | E | * | 12/1938 | White | 42/79 |
| 2,153,246 | A | * | 4/1939 | Gibson | 42/79 |
| 2,270,592 | A | * | 1/1942 | Kitzmiller | 42/79 |
| 2,466,400 | A | * | 4/1949 | Tucker | 42/79 |
| 2,589,738 | A | * | 3/1952 | Sedberry | 42/79 |
| 2,668,479 | A | * | 2/1954 | Batten | 89/14.3 |
| 2,695,797 | A | * | 11/1954 | McCarthy et al. | 285/88 |
| 2,700,839 | A | * | 2/1955 | Finlay et al. | 42/79 |
| 2,847,788 | A | * | 8/1958 | Twigg | 42/79 |
| 2,861,375 | A | * | 11/1958 | Rodick | 42/79 |
| 2,864,194 | A | * | 12/1958 | Grahn | 42/79 |
| 2,867,932 | A | * | 1/1959 | Keightley | 42/79 |
| 2,894,348 | A | * | 7/1959 | Cutts | 42/79 |
| 2,937,465 | A | * | 5/1960 | Denaux | 42/79 |
| 3,045,378 | A | * | 7/1962 | Denaux | 42/79 |
| 3,161,979 | A | * | 12/1964 | Lowe | 42/79 |
| 4,644,930 | A | * | 2/1987 | Mainhardt | 124/58 |
| 4,837,962 | A | * | 6/1989 | Longerot | 42/90 |
| 4,951,409 | A | * | 8/1990 | Froid | 42/90 |
| 6,052,935 | A | * | 4/2000 | Howard | 42/79 |
| 6,557,290 | B2 | * | 5/2003 | Kumler | 42/79 |
| 8,186,091 | B2 | | 5/2012 | Mardaga et al. | |
| 2010/0275492 | A1 | * | 11/2010 | Moller et al. | 42/79 |

* cited by examiner

*Primary Examiner* — Samir Abdosh
(74) *Attorney, Agent, or Firm* — Holland & Hart

(57) ABSTRACT

A firearm choke tube includes a cylindrical body, a choke interrupted thread section, and a locking tab. The choke interrupted thread section is positioned on an outer surface of the cylindrical body and configured to threadably engage an interrupted thread section of a barrel of a firearm to limit longitudinal movement of the cylindrical body relative to the barrel. The locking tab protrudes from the outer surface of the cylindrical body and is configured to interface with a detent formed in the barrel to limit rotational movement of the cylindrical body relative to the barrel.

21 Claims, 12 Drawing Sheets

FIREARM CHOKE TUBE

TECHNICAL FIELD

The present disclosure relates to devices that regulate the spread of shot or pellets leaving the muzzle of a shotgun, and more particularly relates to a shotgun choke tube that is easy to install and remove from the muzzle of a shotgun barrel.

BACKGROUND

A choke is a constriction located near the muzzle of a shotgun barrel that changes the patterning characteristics of a shot charge. Chokes have been used in firearms, and in particular shotguns, for many years to vary the percentage of pellets that will hit a given area of a target at a fixed distance from the muzzle. Some gun barrels have fixed chokes. Many shotguns utilize removable choke tubes so that the shooter can vary the shot pattern according to the game being hunted or the type of target shooting involved.

Removable chokes permit one shotgun to be used for a variety of shooting applications. For example, tight, i.e., smaller exit diameter, chokes are used to maintain a high percentage of the shot charge in a tight pattern at longer distances from the muzzle of the shotgun. This characteristic is desirable for long-range shooting situations encountered when, for example, hunting waterfowl. Tight chokes may also be desirable for some forms of trap shooting. At the other end of the spectrum, a wide shot dispersion may be desirable for short-range shooting situations such as skeet shooting.

The versatility provided by removable chokes involves certain tradeoffs. Many modern choke tubes are threaded inserts, which are secured in shotgun barrel muzzles by using approximately 0.5 inches of very fine, continuous threads. The selection of this thread style is necessitated by the limited wall thickness available for this threaded connection, and the need for a secure installation. A certain amount of thread engagement is required to help ensure that the choke tube will not loosen extensively or be expelled from the barrel during firing. To this end, many choke tubes are provided with continuous threads on their exterior surfaces. The barrel has a corresponding set of continuous threads located on its inner surface. Given this design configuration, a choke tube may require upwards of 20 revolutions for complete insertion or extraction. This process is time-consuming.

Some prior choke tubes have interrupted threads, which speed up the process by which the choke tube is threaded into the firearm barrel. Whether the choke tube has interrupted threads or not, there is a tendency for the choke tubes to loosen with use, which would have detrimental effects. Thus there is a need for a removable choke tube that a user may more easily insert and extract from a firearm using fewer revolutions, but that does not lend itself to excessive loosening or expulsion during use.

SUMMARY

One aspect of the present disclosure relates to a firearm choke tube that includes a cylindrical body, a choke interrupted thread section, and a locking tab. The choke interrupted thread section is positioned on an outer surface of the cylindrical body and configured to threadably engage an interrupted thread section of a barrel of a firearm to limit longitudinal movement of the cylindrical body relative to the barrel. The locking tab protrudes from the outer surface of the cylindrical body and is configured to interface with a detent or other interference type mating feature formed in the barrel to limit rotational movement of the cylindrical body relative to the barrel.

The choke interrupted thread section may include two or more thread portions spaced around a circumference of the cylindrical body. The two or more thread portions are separated circumferentially by a corresponding number of recessed portions that do not include threads. The locking tab may include a ramp portion having a contact surface that faces longitudinally. The detent may be positioned along a distal end surface of the barrel. The detent may include a recess sized to receive a rotational interference member such as the locking tab. The choke tube may include a seal positioned proximal of the choke interrupted thread section to provide a fluid tight seal with the barrel. The locking tab may be positioned distal of the choke interrupted thread section. Rotating the cylindrical body may simultaneously engage the choke interrupted thread section with the interrupted thread section of the barrel and cause the locking tab to interface with the detent. The choke tube may include a collar mounted to the cylindrical body, wherein the collar includes the locking tab.

Another aspect of the present disclosure relates to a firearm choke assembly that includes a firearm barrel and a choke tube insertable into the hollow bore. The firearm barrel includes a distal end surface and a hollow bore. The distal end surface includes a detent and the hollow bore including a barrel interrupted thread section. The choke tube includes a choke interrupted thread section and a locking tab arranged to interface with the detent. The choke tube, when inserted into the hollow bore, is rotatable to engage the choke interrupted thread section with the barrel interrupted thread section to limit longitudinal movement of the choke tube relative to the barrel. Rotation of the choke tube moves the locking tab into contact with the detent while engaging the mating thread sections to limit rotational movement of the choke tube relative to the barrel.

The detent may include a protrusion having a ramp portion, and a recess positioned adjacent the protrusion and sized to receive the locking tab. Rotating the choke tube about ¼ turn may concurrently engage the choke interrupted thread section with the barrel interrupted thread section and move the locking tab into contact with the detent. The detent may include a ramp portion and a recess portion, and moving the locking tab into contact with the detent includes moving the locking tab over the ramp portion and into the recess portion. The choke tube may include a cylindrical body and a collar positioned on an outer surface of the cylindrical body, wherein the collar includes the locking tab. The choke tube may include a cylindrical body, and a choke interrupted thread section formed on an outer surface of the cylindrical body.

A further aspect of the present disclosure relates to a method of releasably mounting a choke tube to a firearm barrel. The method includes providing the barrel with a first thread feature and a detent, and providing the choke tube with a second thread feature and a locking tab. The method also includes inserting the choke tube into the barrel and rotating the choke tube to concurrently engage the first and second thread features to restrict longitudinal movement of the choke tube relative to the barrel, and interface the locking tab and detent to restrict rotational movement of the choke tube relative to the barrel.

The choke tube may include a cylindrical body and a collar positioned on the cylindrical body, wherein the second thread feature includes an interrupted thread section positioned on an outer surface of the cylindrical body, and the collar includes the locking tab. The detent may be formed in a distal end surface of the barrel and include a protrusion portion, wherein the interface of the locking tab with the detent includes moving the locking tab over the protrusion portion. The interface between the locking tab and detent may include contacting the detent with the locking tab, rotating the locking tab past at least a portion of the detent, and holding the locking tab in a fixed rotated position with the detent. The detent may include a protrusion portion and a recess formed in a distal end surface of the barrel, wherein the protrusion portion includes a leading ramp surface and a trailing ramp surface. Rotating the choke tube relative to the barrel may move the locking tab over the leading and trailing ramp surfaces and into the recess. Rotating the choke tube may include approximately a ¼ turn of rotation relative to the barrel.

The foregoing and other features, utilities, and advantages of the subject matter described herein will be apparent from the following more particular description of certain embodiments as illustrated in the accompanying drawings.

DETAILED DESCRIPTION

Figure 1:
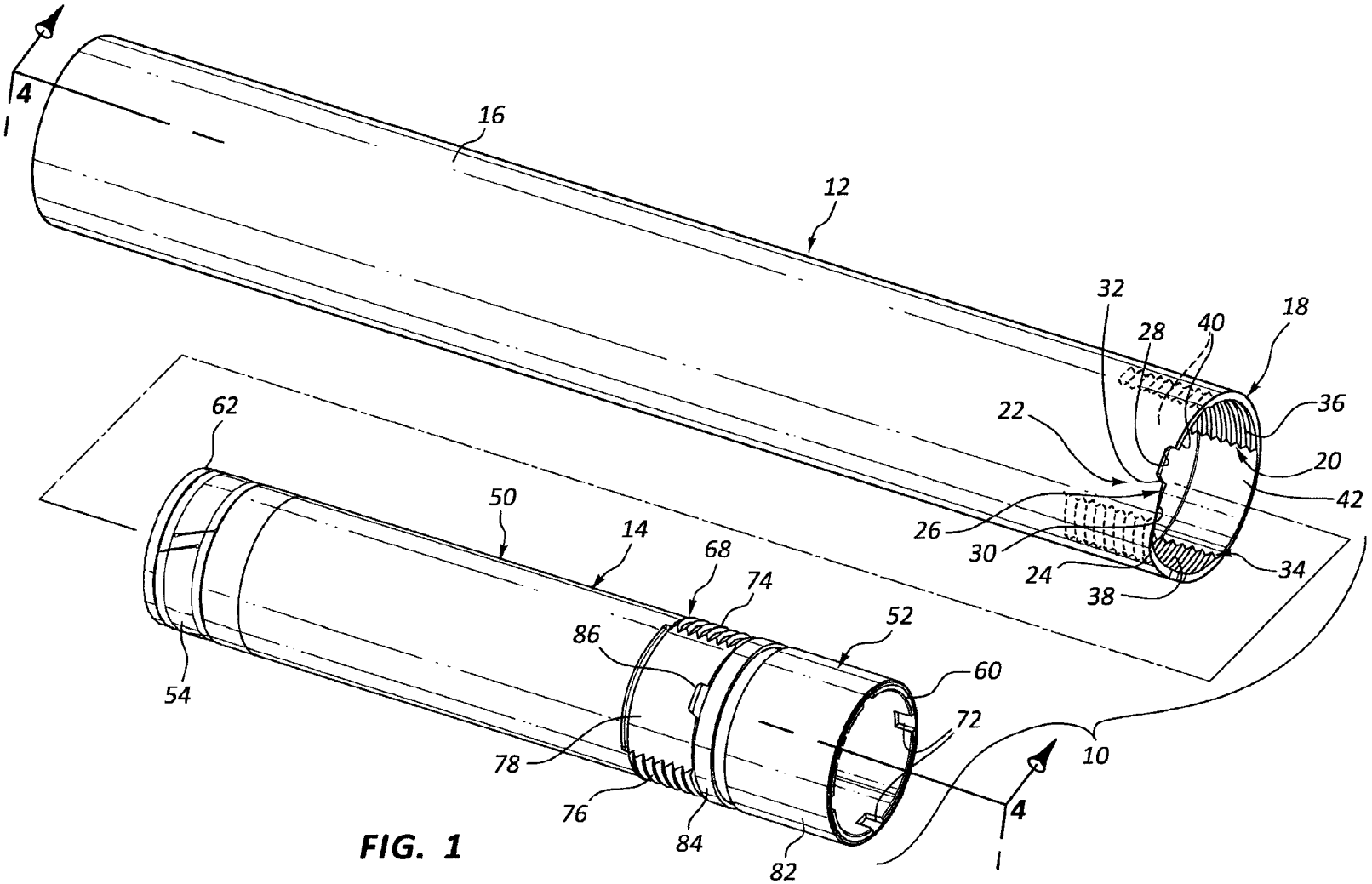
FIG. 1 is an exploded view showing an example firearm choke assembly in accordance with the present disclosure.
Figure 2:
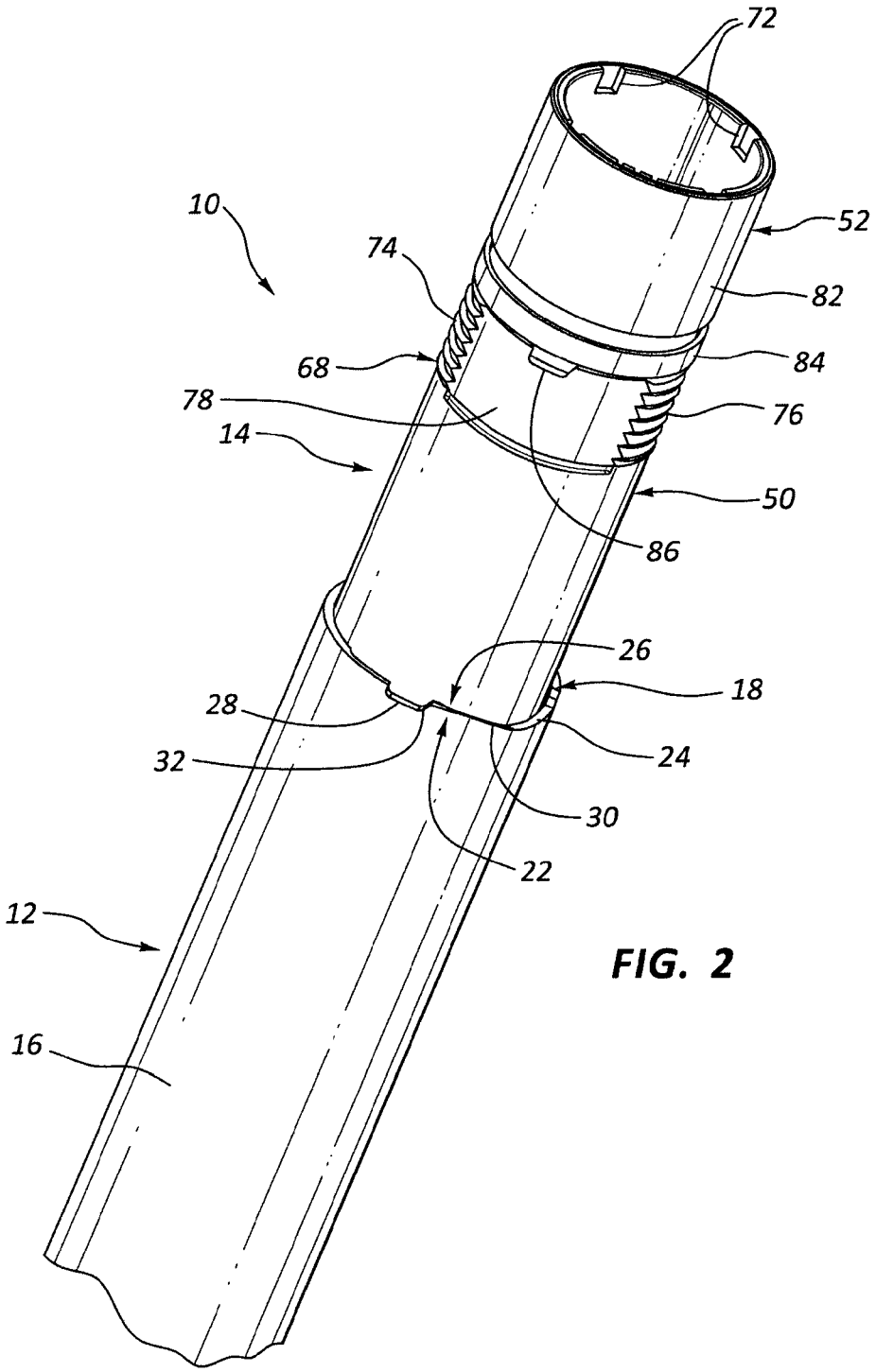
FIG. 2 is a partially assembled view of the firearm choke assembly of FIG. 1.

The present disclosure relates generally to choke tubes for use with firearms, and more particularly relates to a firearm choke assembly that includes a choke tube assembly that is releasably locked in position relative to a firearm barrel. The choke tube assembly includes a threaded section, which when threadably engaged with threads on an internal surface of the firearm barrel limits axial movement of the choke tube assembly relative to the firearm barrel. The choke tube assembly also includes a locking tab, which when rotated into a locked position limits rotational movement of the choke tube assembly relative to the firearm barrel.

The threaded section of the choke tube assembly may be part of a choke interrupted thread section that interfaces with a barrel interrupted thread section formed on an internal surface of the firearm barrel. The choke interrupted thread section, when in a first rotated position, interfaces with the barrel interrupted thread section to permit unobstructed insertion of the choke tube assembly into the firearm barrel. Once the choke tube assembly is inserted completely, the choke tube assembly is rotated to engage the threads of the choke interrupted thread section with the threads of the barrel interrupted thread section. In one example, the choke tube assembly is rotated ¼ turn relative to the firearm barrel to engage the choke interrupted thread section with the barrel interrupted thread section thereby restricting axial movement of the choke tube assembly relative to the firearm barrel.

The locking tab of the choke tube assembly may protrude radially outward from an outer surface of a choke tube of the choke tube assembly. The locking tab may interface with a detent feature formed in the firearm barrel. In one example, the detent feature is formed along a distal end surface of the firearm barrel. The detent may include a ramp member with a tab recess positioned directly adjacent to the ramp member. Rotating the choke tube assembly, once inserted into the firearm barrel with threads of the choke interrupted thread section arranged to engage the threads of the barrel-interrupted thread section, moves the locking tab over the ramp member and into the tab recess. The locking tab positioned within the tab recess cannot be removed out of the tab recess by normal operation of the firearm. The locking tab may be removed from the tab recess upon application of a rotation force applied by the operator of the firearm. The locking tab may be used to limit rotational movement of the choke tube assembly relative to the firearm barrel to hold the choke tube assembly in a locked position.

The firearm choke assembly may include various structures for the locking tab and detent to provide the desired rotational locking of the choke tube assembly relative to the firearm barrel. For example, the detent features may be formed in the firearm barrel at different locations besides along the distal end surface. In one example, the detent may be formed in an insert, collar, or other feature that is mounted to the firearm barrel and configured to interface with the locking tab of the choke tube assembly. In still further arrangements, the firearm barrel includes the locking tab while the choke tube assembly includes detent features that interface with the locking tab.

Typically, the locking tab and detent features of the firearm choke assembly described herein are most useful when used in combination with a threaded interface between the choke tube assembly and firearm barrel. While an interrupted thread section is disclosed herein as a preferred method of providing a threaded interface between the choke tube assembly and firearm barrel, other types of threaded connections are possible including, for example, the combined continuous thread section and interrupted thread section disclosed in U.S. Pat. No. 6,052,935, which is incorporated herein in its entirety by this reference. The use of an interrupted thread section may significantly reduce the time and effort required to threadably connect the choke tube assembly to the firearm barrel and position the locking tab in a position wherein the locking tab may interface with the detent to provide a rotational lock between the choke tube assembly and firearm barrel.

Referring now to FIGS. 1-5, an example firearm choke assembly 10 is shown including a firearm barrel 12 and a choke tube assembly 14. The choke tube assembly 14 is inserted into a distal open end of the firearm barrel. When assembled, a portion of the choke tube assembly 14 is positioned within the firearm barrel 12 and a portion of the choke tube assembly 14 is positioned outside of the firearm barrel 12 (see FIGS. 3A-3C).

The firearm barrel 12 includes an outer surface 16, a distal end surface 18, and a hollow bore 20 (see FIG. 1). The distal end surface 18 includes a detent structure 22. The detent structure 22 includes a tab recess 24, a ramp member 26, and a locking recess 28. The ramp member 26 includes a leading ramp surface 30 adjacent to the tab recess 24, and a trailing ramp surface 32 adjacent to the locking recess 28. The leading ramp surface 30 may have a more gradual, small angle slope as compared to the sharper, high angle slope of the trailing ramp surface 32. The leading ramp surface 30 may be constructed to permit relative rotation of the choke tube assembly 14 to the firearm barrel 12 when moving the choke tube assembly into a locked position. The steep slope of the trailing ramp surface 32 may make it more difficult to rotate the choke tube assembly out of the locked position during operation of the firearm.

The hollow bore 20 may include a barrel interrupted thread section 34 having first and second threaded portions 36, 38 and first and second recessed portions 40, 42. The hollow bore 20 may also include a choke tube seat 44 that is recessed relative to the remaining portions of the hollow bore 20 located proximal of the choke tube seat 44. The choke tube assembly 14, when positioned within the hollow bore 20, may reside within the choke tube seat 44 to be flush-mounted with the remaining portions of the firearm barrel 12 that are proximal of the choke tube seat 44 (see FIG. 4).

The barrel interrupted thread section 34 includes two threaded portions and two recessed portions. In other examples, the barrel interrupted thread section 34 may include different numbers of threaded portions and recessed portions to accommodate the construction of the choke interrupted thread section of the choke tube assembly 14, which will be described in further detail below.

The detent features having the ramp member and recesses formed at the distal end surface 18 may be provided at different locations on the firearm barrel 12 in other embodiments. For example, the firearm barrel 12 may include a channel or slot that is accessible through the distal end surface 18, wherein the channel or slot includes a ramp member, at least one tab recess or other feature that permits locking of the choke tube assembly 14 in a rotational direction relative to the firearm barrel 12.

The choke tube assembly 14 is shown in various views in FIGS. 1-11. The choke tube assembly 14 includes a choke tube 50, a collar 52, and a seal member 54 (see FIG. 1). The choke tube assembly 14 may be assembled together as a single unit that is inserted into the firearm barrel 12. The collar 52 and seal member 54 may be separately mounted to the choke tube 50 and configured as replaceable parts for purposes of, for example, customizing performance of the choke tube assembly 14 and for maintenance. In some arrangements, once assembled, the choke tube assembly 14 has a permanent assembled construction wherein the collar 52 and seal member 54 are fixed to the choke tube 50. In other arrangements, the choke tube assembly 14 is operable without at least one of the collar 52 and seal member 54. For example, provisions may be made within the choke tube assembly 14 to provide adequate sealing without of the use of seal member 54, thereby making the seal member 54 an optional feature of the choke assembly.

Figure 6A:
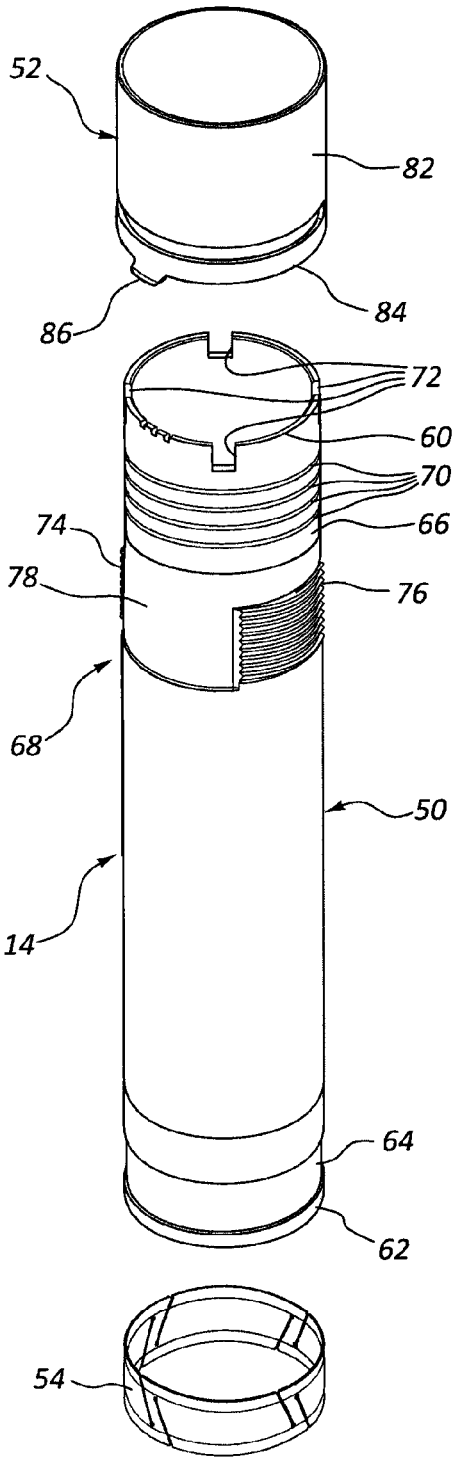
FIGS. 6A and 6B are exploded perspective views of a choke tube assembly of the firearm choke assembly of FIG. 1.
Figure 6B:
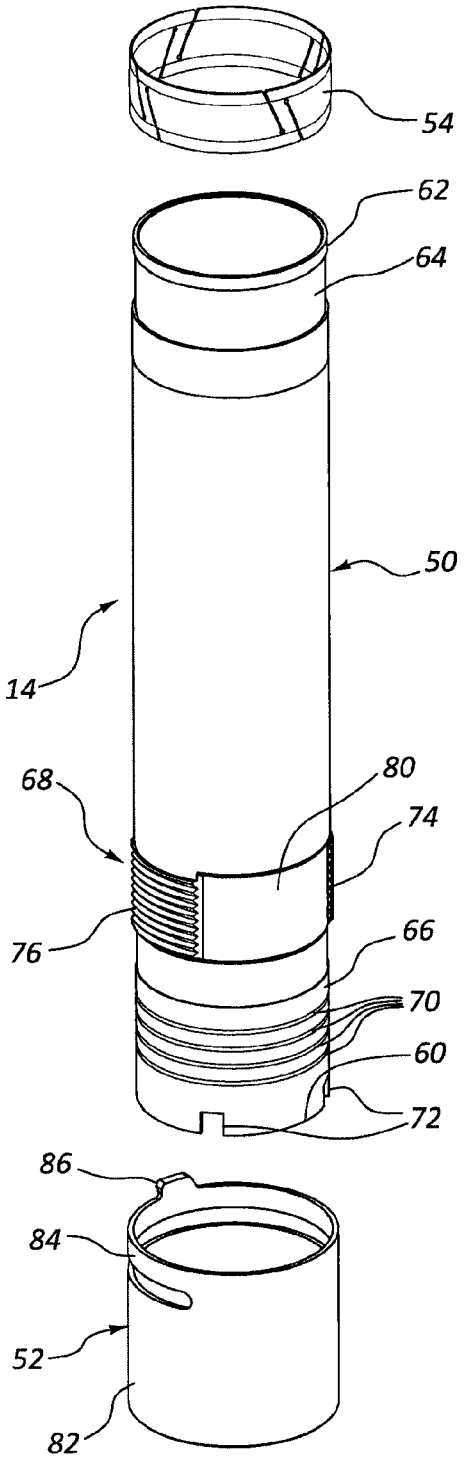
Figure 7:
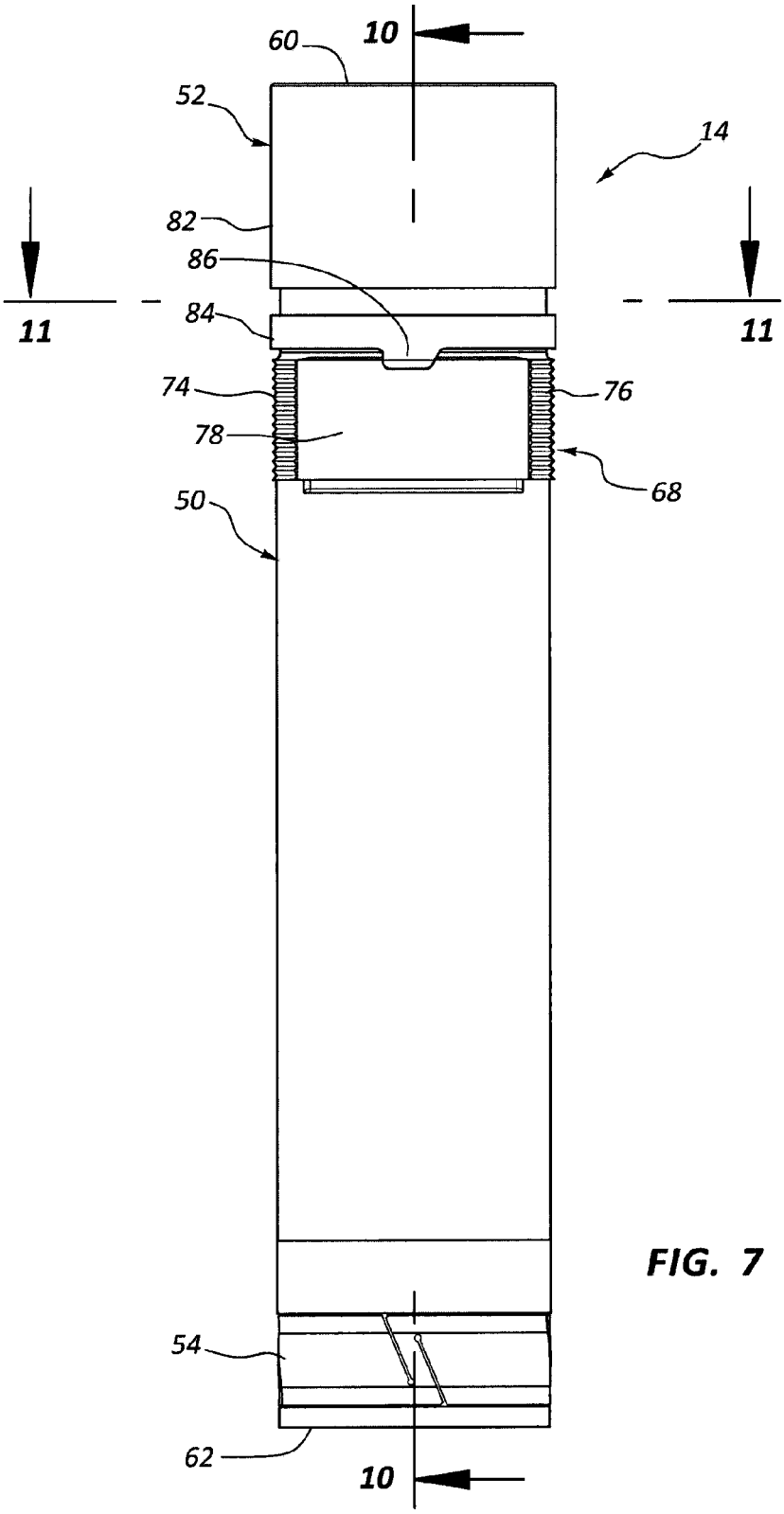
FIG. 7 is a side view of the choke tube assembly of FIGS. 6A and 6B assembled together.
Figure 8:
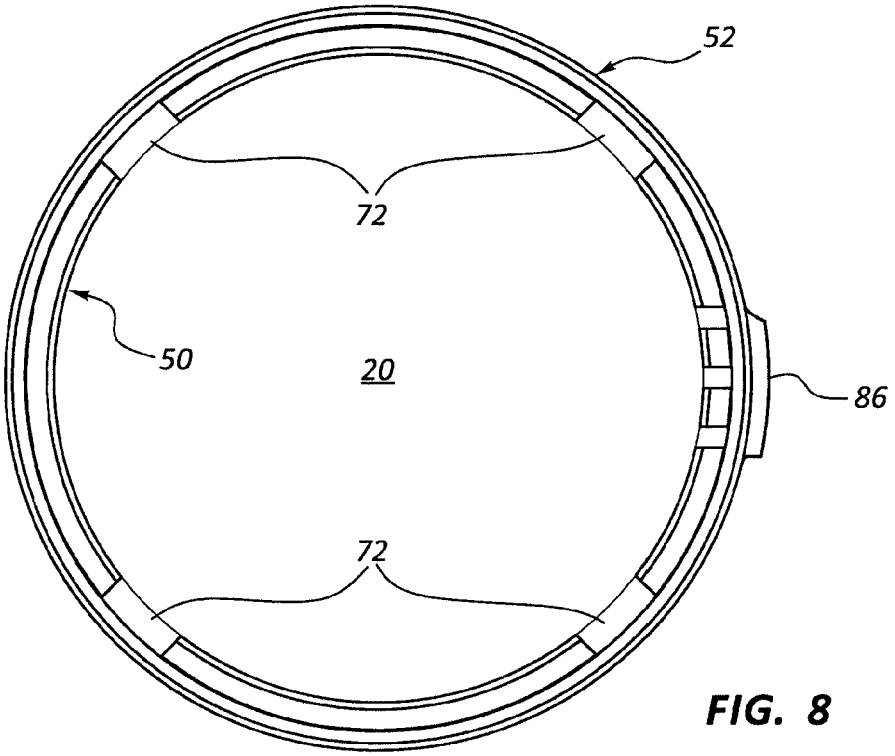
FIG. 8 is a distal end view of the choke tube assembly of FIG. 7.
Figure 9:
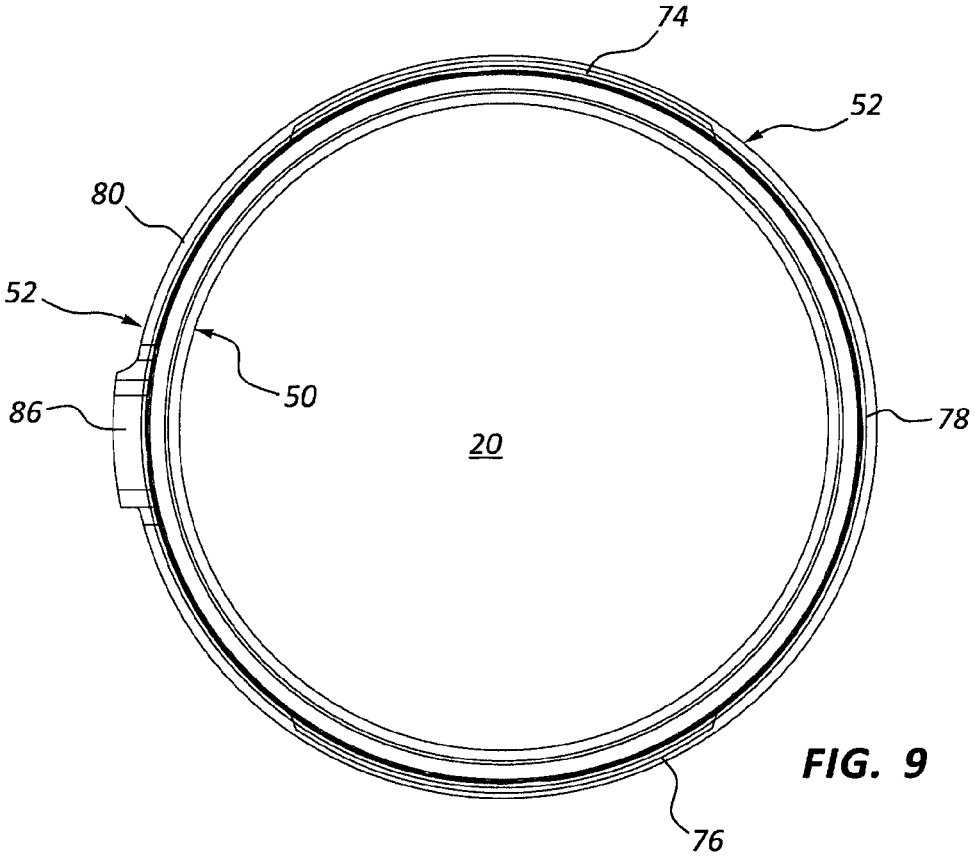
FIG. 9 is a proximal end view of the choke tube assembly of FIG. 7.
Figure 10:
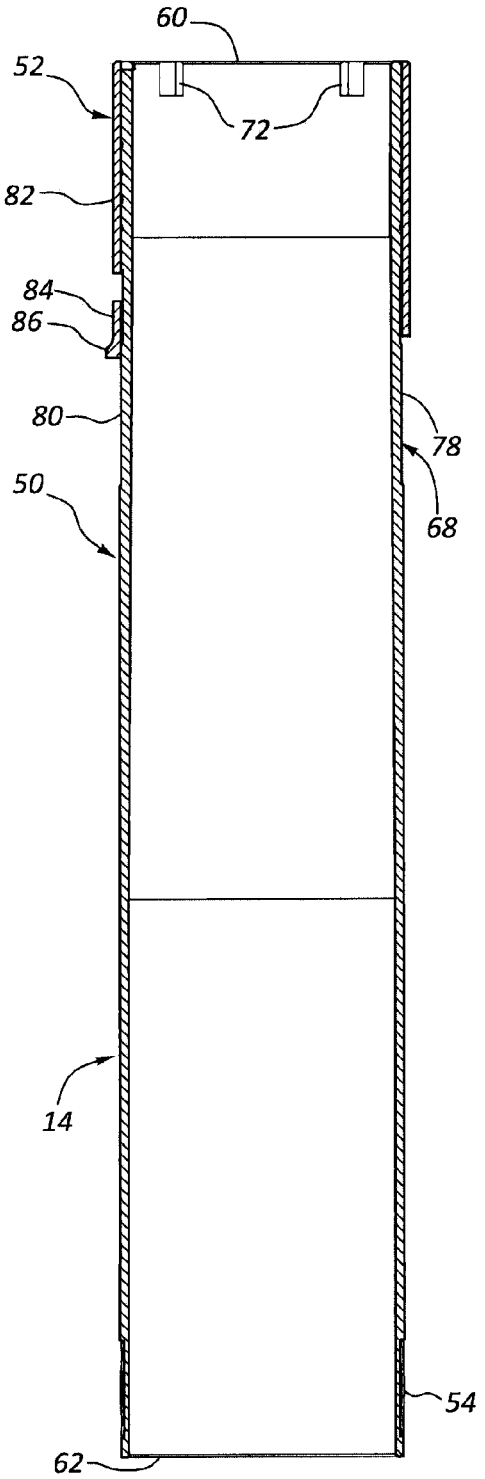
FIG. 10 is a cross-sectional view of the choke tube assembly of FIG. 7 taken along cross-section indicators 10-10.
Figure 11:
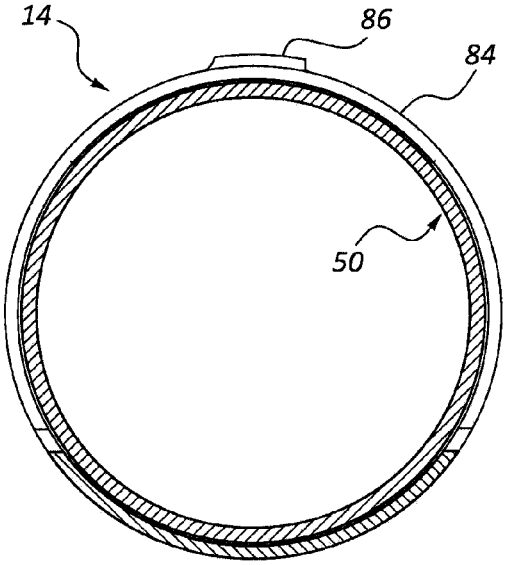
FIG. 11 is a cross-sectional view of the choke tube assembly of FIG. 7 taken along cross-section indicators 11-11.

The choke tube 50 may include distal and proximal end portions 60, 62, a seal seat 64, a collar seat 66, and a choke interrupted thread section 68 (see FIGS. 6A and 6B). The seal seat 64 is sized to receive the seal member 54. The seal member 54 may be configured and arranged to provide a fluid-tight seal with an inner surface of the firearm barrel 12 (i.e., within the choke tube seat 44). The fluid-tight seal provided by seal member 54 may be particularly useful when the barrel and choke tube have mating interrupted threads, such as the barrel interrupted thread section 34 and choke interrupted thread section 68. The seal member 54 may be less relevant when the barrel and choke tube have continuous threads, which when mated provide at least some fluid sealing of the choke tube assembly to the barrel.

The collar seat 66 may include a plurality of circumferential grooves 70 and a plurality of distal cutouts 72. The collar seat 66 may be configured to receive the collar 52 and secure the collar 52 to the choke tube 50. In some arrangements, the collar 52 is connected to the collar seat 66 using, for example, an adhesive, welding, a press-fit or interference fit, or any other desired connection feature.

The choke interrupted thread section 68 includes first and second threaded portions 74, 76 and first and second recessed portions 78, 80 (see FIGS. 6A and 6B). The choke interrupted thread section 68 may have similar dimensions for the first and second threaded portions 74, 76 as the dimension of the first and second threaded portions 36, 38 of the barrel interrupted thread section 34. The choke interrupted thread section 68 may have similar dimensions for the first and second recessed portions 78, 80 as the dimensions for the first and second recessed portions 40, 42 of the barrel interrupted thread section 34. The choke interrupted thread section 68 may have a size, shape, orientation, and other characteristics that provide mating with the barrel interrupted thread section 34.

When inserting the choke tube assembly 14 into the firearm barrel 12, the first and second threaded portion 74, 76 are aligned with the first and second recessed portions 40, 42, and the first and second recessed portions 78, 80 are aligned with the first and second threaded portions 36, 38. When the choke interrupted thread section 68 is aligned with the barrel interrupted thread section 34, the choke tube assembly 14 may be inserted axially into the firearm barrel 12 until the choke interrupted thread section 68 is aligned adjacent to the barrel interrupted thread section 34. Thereafter, rotating the choke tube assembly 14 relative to the firearm barrel 12 engages the first and second threaded portions 74, 76 with the first and second threaded portions 36, 38, respectively. This threaded engagement restricts relative axial movement between the choke tube assembly 14 and the firearm barrel 12.

Operation of the firearm to shoot ammunition imposes significant stress, heat, and vibration on the firearm choke assembly 10, which in some circumstances results in the choke tube assembly 14 rotating relative to the firearm barrel 12. This relative rotation may occur inadvertently upon use of the firearm until the threads of the choke interrupted thread section 68 disengage from the threads of the barrel interrupted thread section 34 allowing the choke tube assembly 14 to disconnect from the firearm barrel 12. The use of the locking tab feature of the choke tube assembly 14 described above and in further detail below restricts such inadvertent relative rotation between the choke tube assembly 14 and firearm barrel 12 during use of the firearm.

The collar 52 includes a base portion 82, flex arm 84, and locking tab 86. The locking tab 86 is mounted to and extends from the flex arm 84. The flex arm 84 permits some axial movement of the locking tab 86 relative to base portion 82. The flex arm 84 is connected to the base portion 82 at a circumferential location spaced opposite from the locking tab 86 (see FIGS. 6A, 6B and 11). The flex arm 84 may act as a cantilever arm or a spring that returns to a rest position after an externally applied force is removed.

Figure 3A:
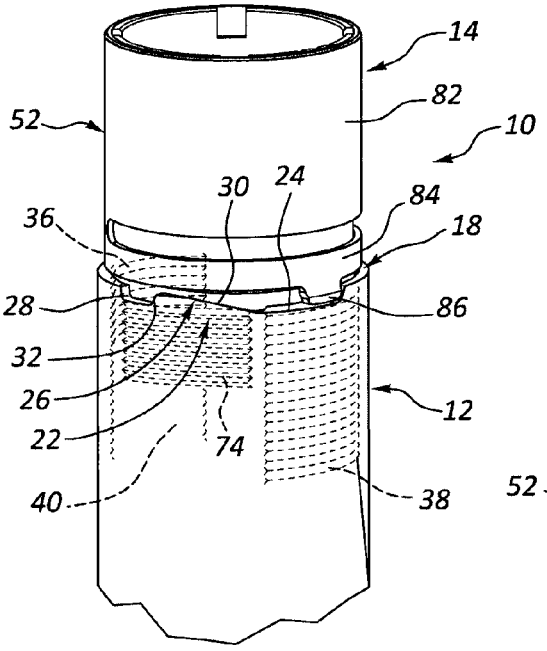
FIG. 3A shows the firearm choke assembly of FIG. 1 assembled and in an unlocked position.
Figure 3B:
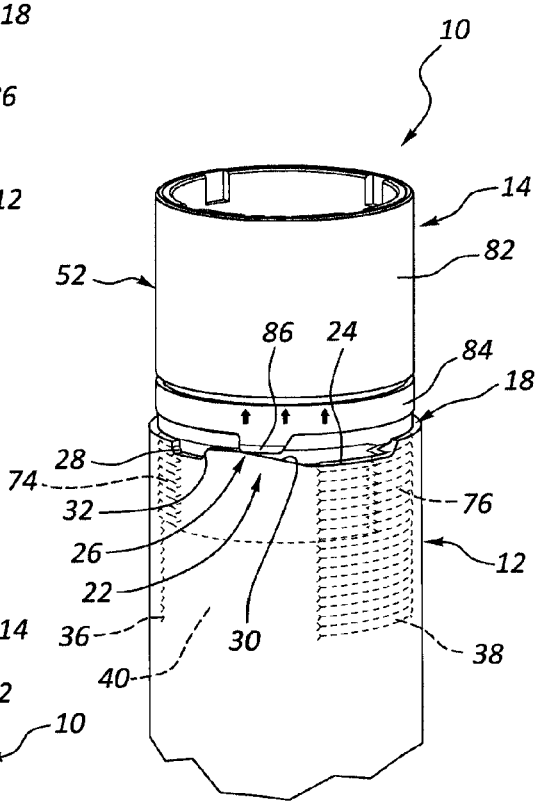
FIG. 3B shows the firearm choke assembly of FIG. 1 in a partially locked position.
Figure 3C:
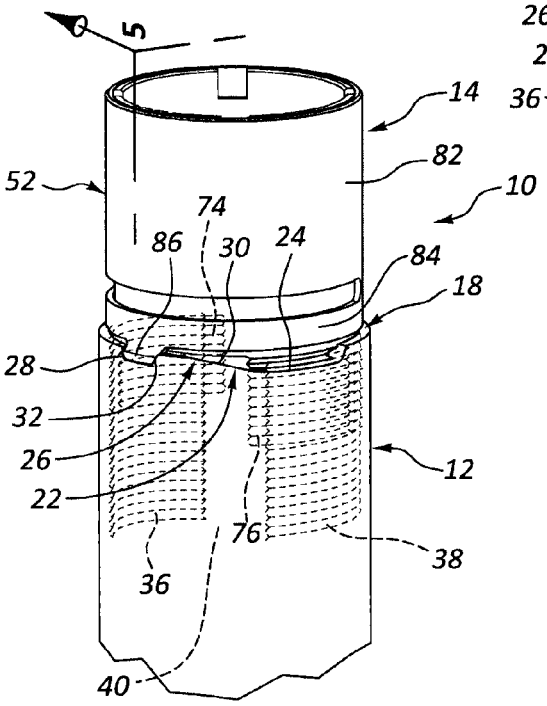
FIG. 3C shows the firearm choke assembly of FIG. 1 in a fully locked position.
Figure 4:
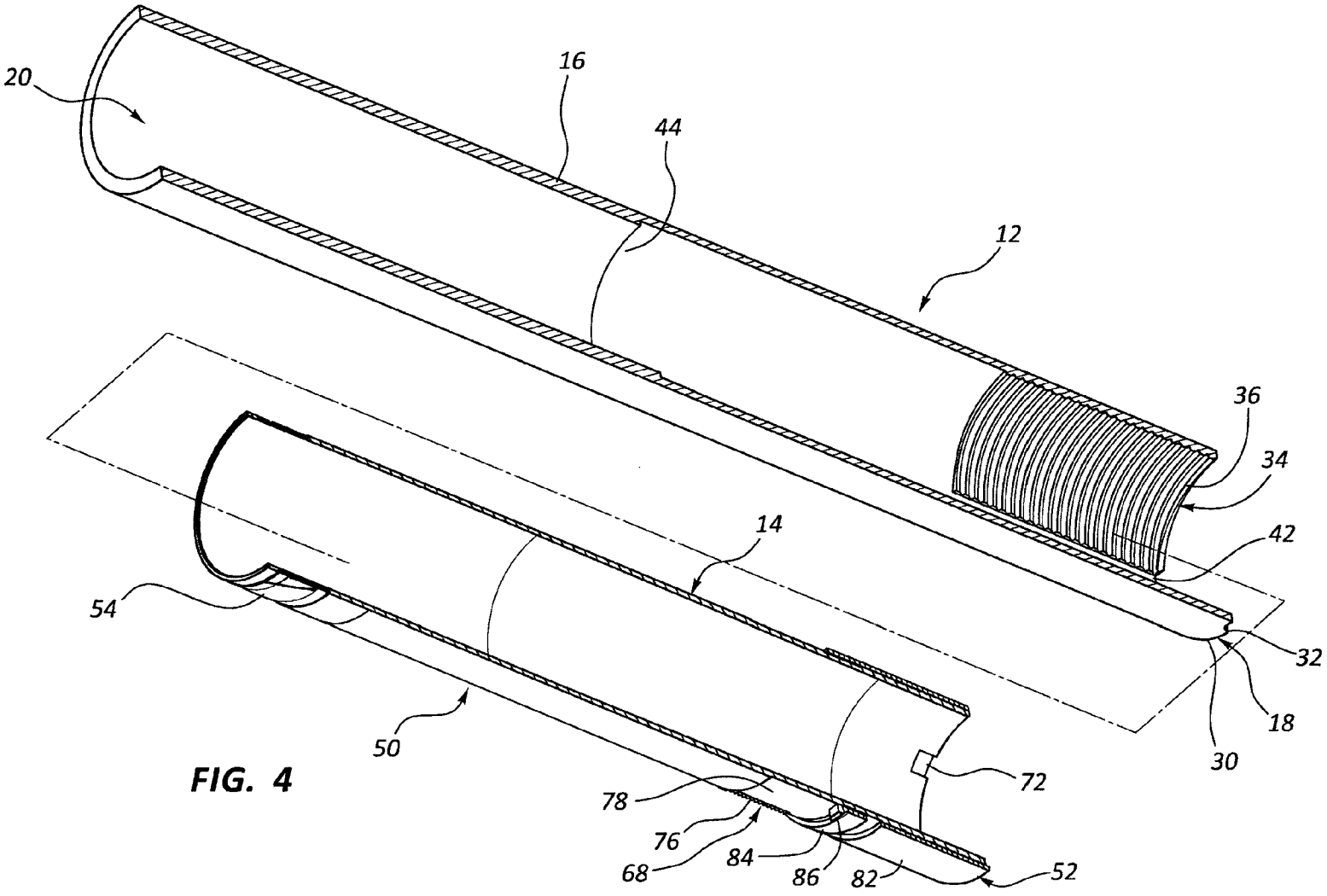
FIG. 4 is a cross-sectional view of the firearm choke assembly of FIG. 1 taken along cross-section indicators 4-4.
Figure 5:
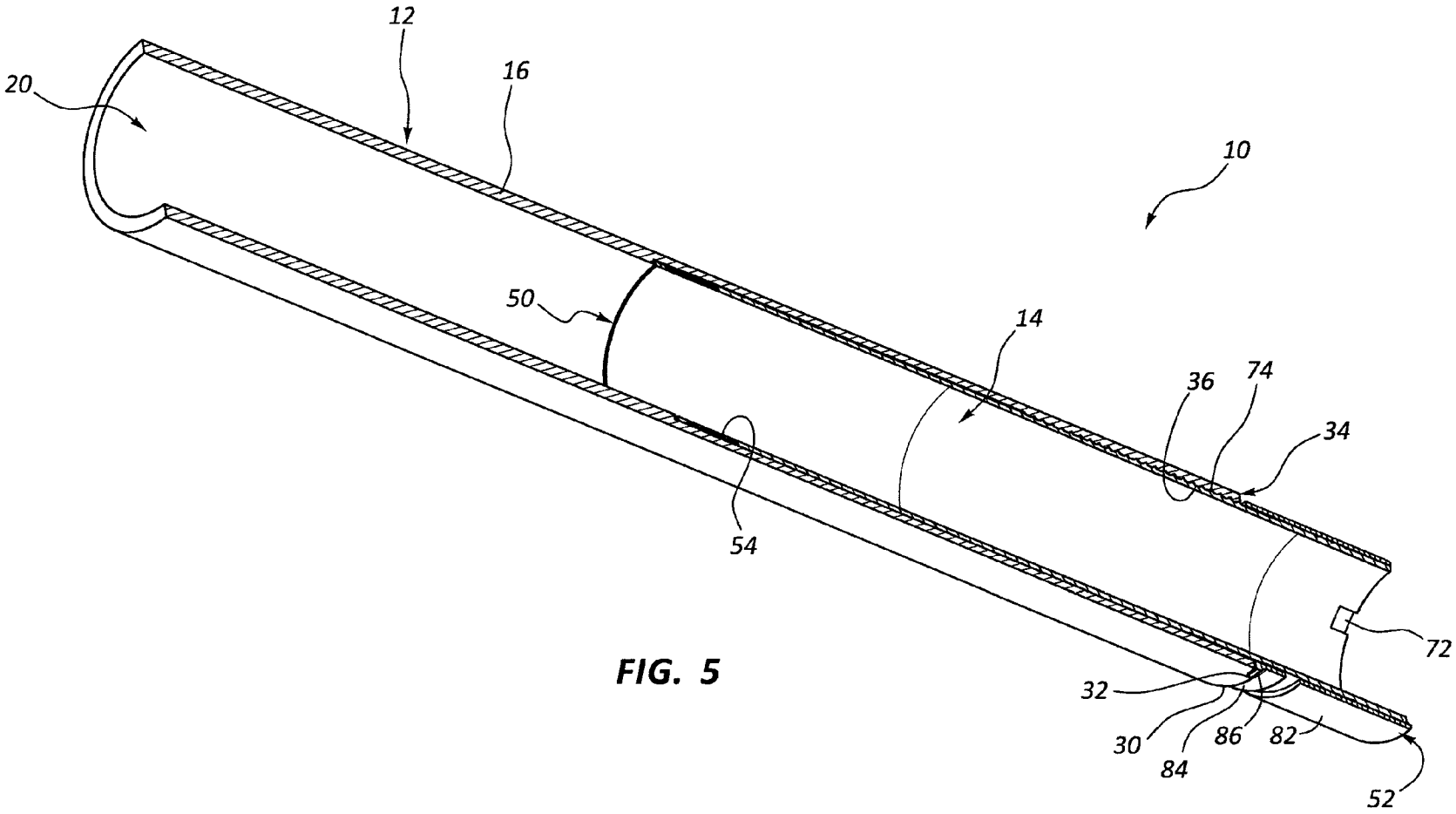
FIG. 5 is a cross-sectional view of the firearm choke assembly of FIG. 3C taken along cross-section indicators 5-5.

Referring to FIGS. 3A-3C, the locking tab 86 is shown interfacing with the detent 22 to lock the choke tube assembly 14 to the firearm barrel 12. FIG. 3A shows the choke tube assembly 14 inserted into the firearm barrel 12 until the locking tab 86 is positioned within the tab recess 24. In this longitudinal and rotational position, the choke tube assembly 14 is in an unlocked position relative to the firearm barrel 12. The first and second threaded portions 74, 76 and first and second threaded portions 36, 38 have not yet engaged to provide a threaded connection between the choke tube assembly 14 and firearm barrel 12, and the locking tab 86 has not yet moved into a locked rotated position relative to detent 22. As such, the choke tube assembly 14 may be moved axially and rotationally relative to the firearm barrel 12 while in the position shown in FIG. 3A.

FIG. 3B shows the choke tube assembly 14 partially rotated toward a locked position. The locking tab 86 is rotated from the tab recess 24 into contact with the ramp member 26. The locking tab 86 moves along the leading ramp surface 30 of the ramp member 26. In the position shown in FIG. 3B, the flex arm 84 flexes or moves axially to permit the locking tab 86 to move axially as the locking tab 86 moves along the leading ramp surface 30 of the ramp member 26. The flex arm 84 may be referred to as a biasing member or spring that automatically moves axially away from the ramp member 26 and then automatically returns in the opposite axial direction after the locking tab 86 moves into the locking recess 28 upon rotation of the choke tube assembly 14.

The threads of the choke interrupted thread section 68 begin initial engagement with threads of the barrel interrupted thread section 34 as the choke tube assembly 14 rotates relative to the firearm barrel 12 to contact locking tab 86 with ramp member 26.

FIG. 3C shows the locking tab 86 positioned within the locking recess 28. The flex arm 84 has automatically moved back to its original axial position (e.g., the position when the locking tab 86 is positioned in the tab recess 24 as shown in FIG. 3A). The choke tube assembly 14 is in a rotational locked position relative to the firearm barrel 12. The choke tube assembly 14 is also locked in an axial position relative to firearm barrel 12 by engagement of the first and second threaded portions 74, 76 with the first and second threaded portions 36, 38, respectively. The choke tube assembly 14 has rotated through approximately ¼ turn relative to firearm barrel 12 to move the locking tab 86 into the locked position and to move the threads of the choke interrupted thread section 68 into engagement with threads of the barrel interrupted thread section 34.

Different amounts of relative rotation may be used in other examples in order to move the locking tab 86 into a locked position and to engage the threads of the choke interrupted thread section 68 with threads of the barrel interrupted thread section 34. In one example, the rotation is in the range of about ⅛ turn to about ½ turn, and more preferably about ⅙ turn to about ⅓ turn.

The locking tab 86 may be moved out of the locking recess 28 upon application of a rotational force in an opposite direction. The rotational force required to move the locking tab 86 out of the locking recess 28 is typically greater than any rotational force applied during normal use of the firearm. The locking tab 86 moves over the trailing ramp surface 32, along the leading ramp surface 30, and into the tab recess 24. Once the locking tab 86 is in the tab recess 24 (see FIG. 3A), the first and second threaded portions 74, 76 are disengaged from the first and second threaded portions 36, 38, respectively, so that the choke tube assembly 14 may move axially relative to firearm barrel 12 for removal of the choke tube assembly 14.

The collar 52 is constructed to provide movement of the locking tab 86 via the flex arm 84 in an axial direction after engagement of threads of the choke interrupted thread section 68 and barrel interrupted thread section 34. In other arrangements, the locking tab 86 itself may be elastically movable as the locking tab 86 moves along the ramp member 26 and into and out of the locking recess 28. The locking tab 86 may provide movement in an axial direction without use of the flex arm 84 as a result of a construction of the locking tab 86 or an attachment configuration of the locking tab 86 to the base portion 82.

As described above, the mounting of locking tab 86 and detent 22 may be switched so that the locking tab 86 is carried by the firearm barrel 12 and the features of detent 22 are carried by the choke tube assembly 14. Further, while the locking tab 86 is shown in the figures being provided on a collar 52 that is separate from the choke tube 50, other arrangements are possible in which the locking tab 86 is integrally formed as single piece with a choke tube 50.

In still further examples, the detent may be constructed without a ramp member. The detent may include only a locking recess within which the locking tab moves into and out of at a certain rotated position of the choke tube assembly 14 relative to the firearm barrel 12. In one example, the locking tab 86 is automatically biased toward the locking recess 28 when the choke tube assembly 14 is inserted into the firearm barrel 12 to an axial position in which the choke interrupted thread section 68 is positioned to engage threads of the barrel interrupted thread section 34.

Other locking features are possible to provide a locked rotated position of the choke tube assembly relative to the firearm barrel. The locking tab and detent features disclosed herein are merely exemplary and may be replaced with other features that will lock the choke tube assembly 14 rotationally relative to the firearm barrel 12, and provide unlocking so that the choke tube assembly may be removed from the firearm barrel as desired. Likewise, other features besides threads or interrupted thread sections may be used to lock the choke tube assembly 14 axially relative to barrel 12, and provide unlocking for removal of the choke tube assembly.

Figure 12A:
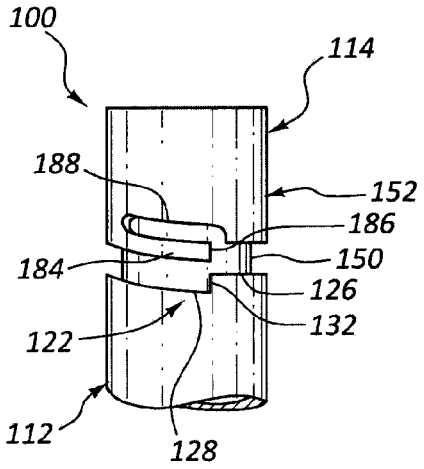
FIGS. 12A-12F are side views of alternative locking features for a firearm choke assembly in accordance with the present disclosure.

FIGS. 12A-12F illustrate several additional exemplary locking features for choke tube assemblies. FIG. 12A shows a firearm choke tube assembly 100 that includes a firearm barrel 112 and a choke tube assembly 114. The firearm barrel 112 includes a detent feature 122 having a ramp member 126 and a locking recess 128. The ramp member 126 includes a trailing ramp surface 132. The choke tube assembly 114 includes a choke tube 150 and a collar 152. The collar 152 is mounted to the choke tube 150 and includes a flex arm 184. The flex arm 184 includes a tab surface 186. The firearm barrel 122 and choke tube assembly 114 may include interrupted thread sections such as the barrel interrupted thread section 34 and choke interrupted thread section 68 described above with reference to the firearm choke assembly 10. The flex arm 184 flexes axially into a cutout 188 as the choke tube assembly 114 rotates relative to the firearm barrel 112. Once the tab surface 186 moves past the trailing ramp surface 132, the flex arm 184 moves into the locking recess 128. The tab surface 186 contacts the trailing ramp surface 132 to resist reverse rotation of the choke tube assembly 114 relative to the firearm barrel 112.

Figure 12B:
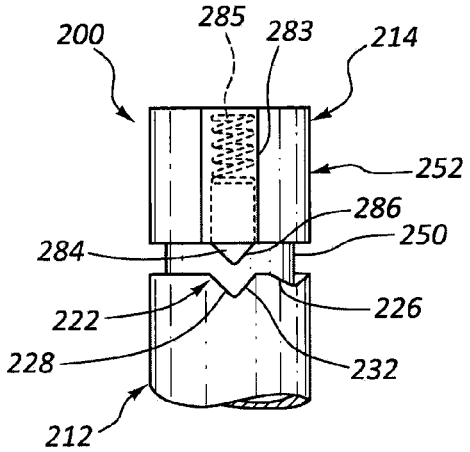

FIG. 12B shows another example firearm choke assembly 200 that includes a firearm barrel 212 and a choke tube assembly 214. The firearm barrel 212 includes a detent 222 having a ramp member 226 and a locking recess 228. The ramp member 226 includes a trailing ramp surface 232. The trailing ramp surface 232 may be part of the locking recess 228.

The choke tube assembly 214 includes a choke tube 250 and a collar 252. The collar 252 is mounted to the choke tube 250 and includes a follower 284 having a tab surface 286. The follower 284 moves axially within a housing 283 mounted to an exterior surface or within a wall of the collar 252. The follower 284 moves against forces applied by a biasing member 285, which biases the follower 284 toward the detent 222.

As with the other example firearm choke assemblies described with reference to FIGS. 12A-12F, the firearm choke assembly 200 may include interrupted thread sections that provide a threaded interface between the firearm barrel 212 and choke tube assembly 214. As the choke tube assembly 214 rotates relative to the firearm barrel 212, the follower moves along the ramp member 226 and into the locking recess 228. The follower 284 moves axially as the follower member 284 moves along the ramp member 226 and into the locking recess 228 against biasing forces applied by the biasing member 285. Once the follower 284 is positioned within the locking recess 228, the tab surface 286 contacts the trailing ramp surface 232 to resist reverse rotation of the choke tube assembly 214 relative to the firearm barrel 212.

Figure 12C:
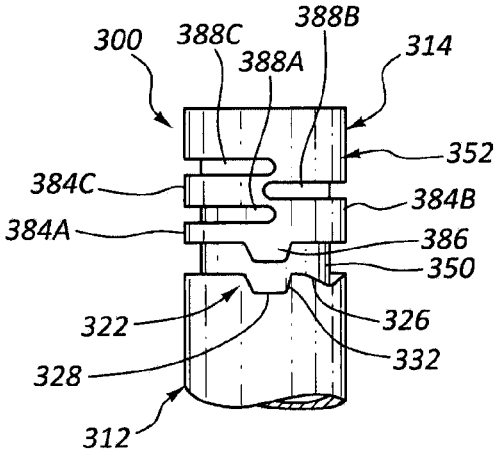

FIG. 12C shows another example firearm choke assembly 300 including a firearm barrel 312 and a choke tube assembly 314. The firearm barrel 312 includes a ramp member 326 and a locking recess 328. The ramp member 326 includes a trailing ramp surface 332. The choke tube assembly 314 includes a choke tube 350 and a collar 352. The collar 352 includes a plurality of flex arms 384A-384C defined at least in part by a plurality of cutouts 388A-388C. A locking tab 386 is carried at least in part by the flex arm 384A. During rotation of the choke tube assembly 314 relative to the firearm barrel 312, the flex arms 384A-384C provide at least some elastic flexing that permits the locking tab 386 to move along the ramp member 326 and then drop into the locking recess 328. The locking tab 386 contacts the trailing ramp surface 332 to resist reverse rotation of the choke tube assembly 314 relative to the firearm barrel 312.

Figure 12D:
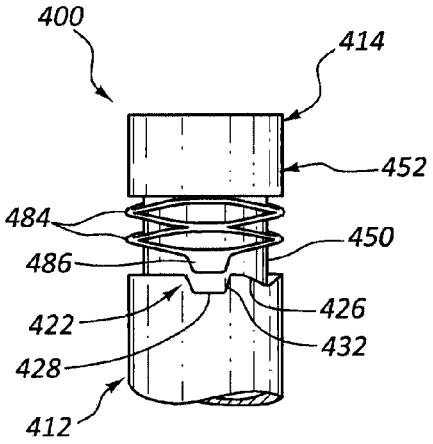

FIG. 12D shows another example firearm choke assembly 400 including a firearm barrel 412 and a choke tube assembly 414. The firearm barrel 412 includes a detent 422 having a ramp member 426 and a locking recess 428. A ramp member 426 includes a trailing ramp surface 432. The choke tube assembly 414 includes a choke tube 450 and a collar 452. The collar 452 includes a flex arm 484 in the form of a spring member. A locking tab 486 is carried by the flex arm 484. The flex arm 484 permits the locking tab 486 to move axially relative to the firearm barrel 412 as the choke tube assembly 414 rotates relative to the firearm barrel 412. The locking tab 486 moves along the ramp member 426 and drops into the locking recess 428. The locking tab 486 contacts the trailing ramp surface 432 to resist reverse rotation of the choke tube assembly 414 relative to the firearm barrel 412.

Figure 12E:
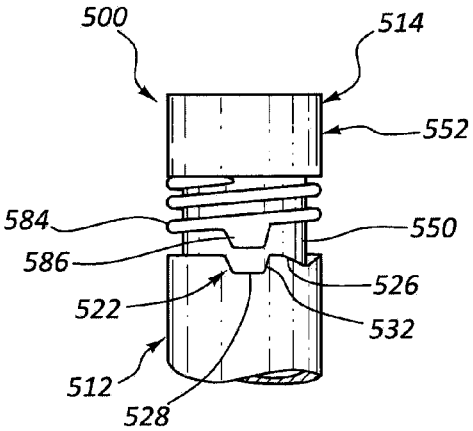

FIG. 12E shows a firearm choke assembly 500 including a firearm barrel 512 and a choke tube assembly 514. The firearm barrel 512 includes a detent 522 having a ramp member 526 and a locking recess 528. Ramp member 526 includes a trailing ramp surface 532. The choke tube assembly 514 includes a choke tube 550 and a collar 552 mounted to the choke tube 550. The collar 552 includes a flex arm 584 in the form of a helical shaped spring. A locking tab 586 is carried by the flex arm 584. The firearm choke tube assembly 514 rotates relative to the firearm barrel 512 to move the locking tab 586 along the ramp member 526 and into the locking recess 528. Contact between a locking tab 586 and the trailing ramp surface 532 resists reverse rotation of the choke tube assembly 514 relative to the firearm barrel 512.

Figure 12F:
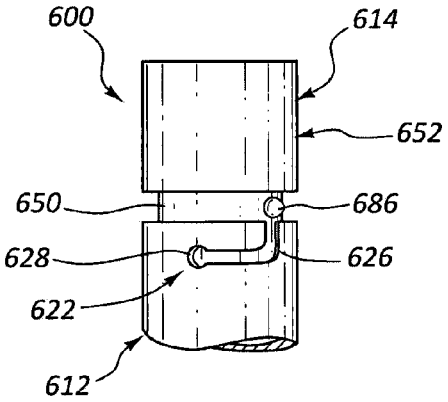

FIG. 12F shows a firearm choke assembly 600 including a firearm barrel 612 and a choke tube assembly 614. The firearm barrel 612 includes a detent 622 having a track 626 that leads to a locking recess 628. The choke tube assembly 614 includes a choke tube 650 and a collar 652. A locking tab 686 may be mounted to either the choke tube 650 or the collar 652. The locking tab 686 may be in the form of a protrusion that is sized and arranged to travel along the track 622 and into the locking recess 628 upon relative rotation between the choke tube assembly 614 and firearm barrel 612. The locking recess 628 may be sized, shaped and arranged such that the locking tab 686 is held therein to resist reverse rotation of the choke tube assembly 614 relative to the firearm barrel 612.

Figure 13A:
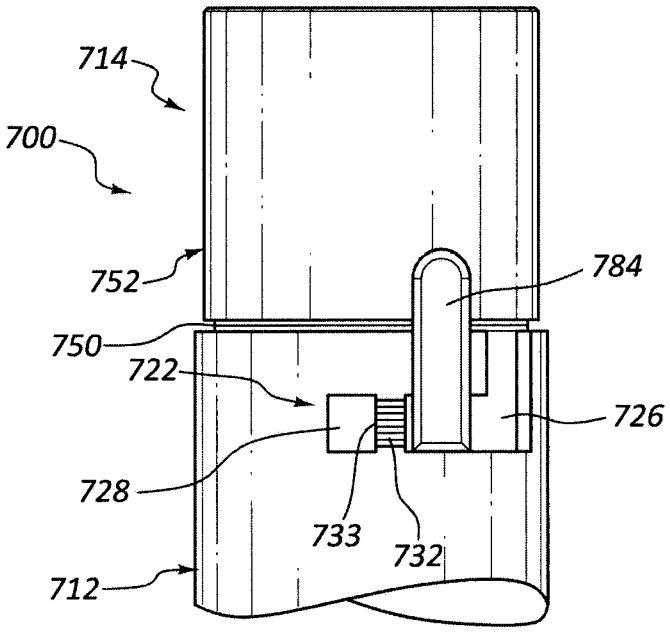
FIGS. 13A-13B are side views of alternative locking features for a firearm choke assembly in accordance with the present disclosure.
Figure 13B:
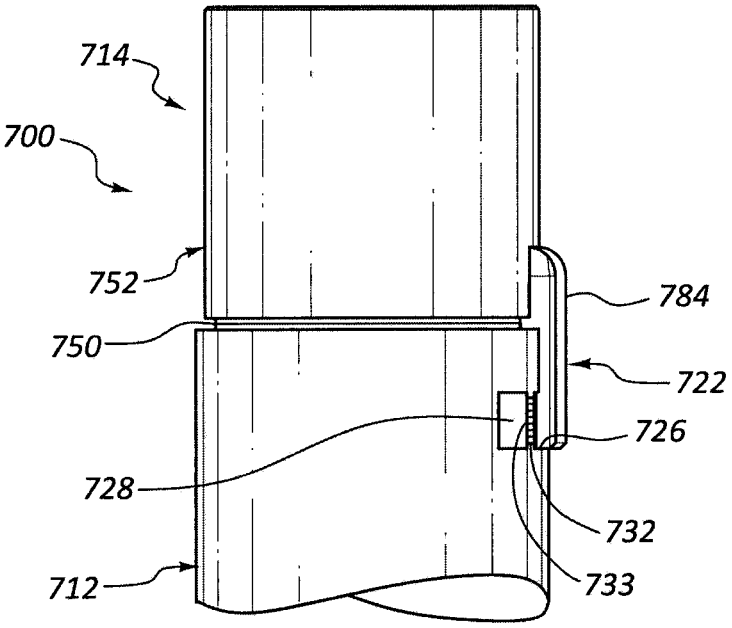

FIGS. 13A and 13B show another example firearm choke assembly 700 including a firearm barrel 712 and a choke tube assembly 714. The firearm barrel 712 includes a detent 722 having a track 726 and a locking recess 728. Track 726 includes a ramp 732 that leads into the locking recess 728. The choke tube assembly 714 includes a choke tube 750 and a collar 752 mounted to the choke tube 750. The collar 752 includes a flex arm 784 that carries a locking tab 786. The locking tab 786 travels along the track 726, over the ramp 732, and into the locking recess 728 as part of connecting the choke tube assembly 714 to the firearm barrel 712. Contact between the locking tab 786 and a trailing ramp surface 733 of the locking recess 728 resists reverse rotation of the choke tube assembly 714 relative to the firearm barrel 712. FIG. 13B shows the flex arm 784 extending outside of an outer profile of the firearm barrel 712.

In each of the examples of FIGS. 12A-13B, an additional force may be applied to the choke tube assembly 614 to move the locking tab out of the locking recess. This additional force may be a force applied directly to the locking tab or some other portion of the flex arm or collar of the choke tube assembly. The additional force may be a force applied in a direction different from a force typically applied when the firearm is shot (e.g., an axial force applied to the choke tube assembly in a direction away from the firearm barrel).

As is illustrated by the several examples of FIGS. 1-13B, there are many different ways in which a choke tube assembly may be releasably secured to a firearm barrel in a way that resists inadvertent relative rotation between the choke tube assembly and firearm barrel in at least one rotation direction. The example shown in the figures are some of the many ways in which interrupted thread sections may be used with a firearm choke assembly without inadvertent disconnection of the choke tube assembly from the firearm barrel.

In one alternative example, also referred to as a reversed locking mechanism, the locking tab is carried by the firearm barrel and the detent structure is carried by the choke tube assembly. The firearm barrel may include a flex arm or other structure that provides at least some axial movement of the locking tab as the locking tab moves into a locking recess of the detent of the choke tube assembly. In some arrangements, the locking tab alone includes sufficient flexibility (e.g., elastic deformation) that permits at least some axial movement without the need for a separate flex arm formed in or carried by the firearm barrel. The detent structure may be formed in a collar of the choke tube assembly or directly in a choke tube of the choke tube assembly.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. The subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

As used herein, spatial or directional terms, such as "left," "right," "front," "back," and the like, relate to the subject matter as it is shown in the drawing figures. However, it is to be understood that the subject matter described herein may assume various alternative orientations and, accordingly, such terms are not to be considered as limiting. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A firearm choke tube for attachment to a muzzle end of a firearm barrel, the firearm choke tube comprising:

a cylindrical body;

a choke interrupted thread section positioned on an outer surface of the cylindrical body and configured to threadably engage an interrupted thread section of a muzzle end of a barrel of a firearm to limit longitudinal movement of the cylindrical body relative to the barrel;

a locking tab protruding from the outer surface of the cylindrical body and configured to interface with a detent formed in the barrel to limit rotational movement of the cylindrical body relative to the barrel.

2. The firearm choke tube of claim 1 wherein the choke interrupted thread section includes at least two thread portions spaced around a circumference of the cylindrical body and separated circumferentially by at least two recessed portions that do not include threads.

3. The firearm choke tube of claim 1 wherein the locking tab includes a ramp portion facing longitudinally.

4. The firearm choke tube of claim 1 wherein the detent is positioned along a distal end surface of the barrel.

5. The firearm choke tube of claim 1 wherein the detent includes a recess sized to receive the locking tab.

6. The firearm choke tube of claim 1 further comprising a seal positioned proximal of the choke interrupted thread section.

7. The firearm choke tube of claim 1 wherein the locking tab is positioned distal of the choke interrupted thread section.

8. The firearm choke tube of claim 1 wherein rotating the cylindrical body simultaneously engages the choke interrupted thread section with the interrupted thread section of the barrel and causes the locking tab to interface with the detent.

9. The firearm choke tube of claim 1 further comprising a collar mounted to the cylindrical body, the collar including the locking tab.

10. A firearm choke assembly, comprising:

a firearm barrel having a distal end surface at a muzzle end and a hollow bore, the distal end surface including a detent and the hollow bore including a barrel interrupted thread section;

a choke tube insertable into the hollow bore and comprising:

a choke interrupted thread section;

a locking tab arranged to interface with the detent;

wherein the choke tube, when inserted into the hollow bore, is rotatable to engage the choke interrupted thread section with the barrel interrupted thread section to limit longitudinal movement of the choke tube relative to the barrel, and rotation of the choke tube moves the locking tab into contact with the detent while engaging the mating thread sections to limit rotational movement of the choke tube relative to the barrel.

11. The firearm choke assembly of claim 10 wherein the detent includes a protrusion having a ramp portion, and a recess positioned adjacent the protrusion and sized to receive the locking tab.

12. The firearm choke assembly of claim 10 wherein rotating the choke tube no more than ¼ turn concurrently engages the choke interrupted thread section with the barrel interrupted thread section and moves the locking tab into contact with the detent.

13. The firearm choke assembly of claim 10 wherein the detent includes a ramp portion and a recess portion, and moving the locking tab into contact with the detent includes moving the locking tab over the ramp portion and into the recess portion.

14. The firearm choke assembly of claim 10 wherein the choke tube includes a cylindrical body and a collar positioned on an outer surface of the cylindrical body, the collar including the locking tab.

15. The firearm choke assembly of claim 10 wherein the choke tube includes a cylindrical body, and the choke interrupted thread section is formed on an outer surface of the cylindrical body.

16. A method of releasably mounting a choke tube to a muzzle end of a firearm barrel, comprising:

providing the barrel with a first thread feature and a detent at the muzzle end, and providing the choke tube with a second thread feature and a locking tab;

inserting the choke tube into the barrel;

rotating the choke tube to concurrently engage the first and second thread features to restrict longitudinal movement of the choke tube relative to the barrel, and interface the locking tab and detent to restrict rotational movement of the choke tube relative to the barrel.

17. The method of claim 16 wherein the choke tube includes a cylindrical body and a collar positioned on the cylindrical body, the second thread feature including an interrupted thread section positioned on an outer surface of the cylindrical body, and the collar including the locking tab.

18. The method of claim 16 wherein the detent is formed in a distal end surface of the barrel, the detent including a protrusion portion, and the interface of the locking tab with the detent includes moving the locking tab over the protrusion portion.

19. The method of claim 16 wherein the interface between the locking tab and detent includes contacting the detent with the locking tab, rotating the locking tab past at least a portion of the detent, and holding the locking tab in a fixed rotated position with the detent.

20. The method of claim 16, wherein the detent includes a protrusion portion and a recess formed in a distal end surface of the barrel, the protrusion portion including a leading ramp surface and a trailing ramp surface, and rotating the choke tube relative to the barrel moves the locking tab over the leading and trailing ramp surfaces and into the recess.

21. The method of claim 16 wherein rotating the choke tube includes no more than ¼ turn of rotation relative to the barrel.

* * * * *